United States Patent [19]

Klemmensen

[11] Patent Number: 4,872,318

[45] Date of Patent: Oct. 10, 1989

[54] SHUT-OFF MECHANISM FOR ICE MAKER

[75] Inventor: Ramon L. Klemmensen, Cedar Rapids, Iowa

[73] Assignee: Amana Refrigeration, Inc., Amana, Iowa

[21] Appl. No.: 272,843

[22] Filed: Nov. 18, 1988

[51] Int. Cl.[4] ..... F25C 5/18

[52] U.S. Cl. ..... 62/137; 62/344

[58] Field of Search ..... 62/137, 344

[56] References Cited

U.S. PATENT DOCUMENTS

| | | | |
|---|---|---|---|
| 2,969,654 | 1/1961 | Harle | 62/137 X |
| 3,514,964 | 6/1970 | Dodge III et al. | 62/137 |
| 3,545,217 | 12/1970 | Linstromberg | 62/137 |
| 3,621,668 | 11/1971 | Swerbinsky | 62/137 |
| 3,911,692 | 10/1975 | Maxwell et al. | 62/137 |
| 3,926,007 | 12/1975 | Braden et al. | 62/137 |
| 4,100,761 | 7/1978 | Linstromberg et al. | 62/137 |

*Primary Examiner*—William E. Tapolcai

*Attorney, Agent, or Firm*—William R. Clark; Richard M. Sharkansky

[57] ABSTRACT

A shut-off mechanism for an automatic ice maker that cooperates with the ice feeler arm to deactivate the harvesting of ice when the ice storage bin is not properly positioned to receive ice. When the storage bin is absent, a biased plunger of the shut-off mechanism urges the feeler arm to a raised position that deactivates the ice maker. However, when the storage bin is properly positioned, the bin engages the plunger and secures it in a retracted position such that the feeler arm is free to pivot in its normal manner for sensing the level of ice in the storage bin and controlling the ice maker accordingly.

6 Claims, 4 Drawing Sheets

FIG. 3
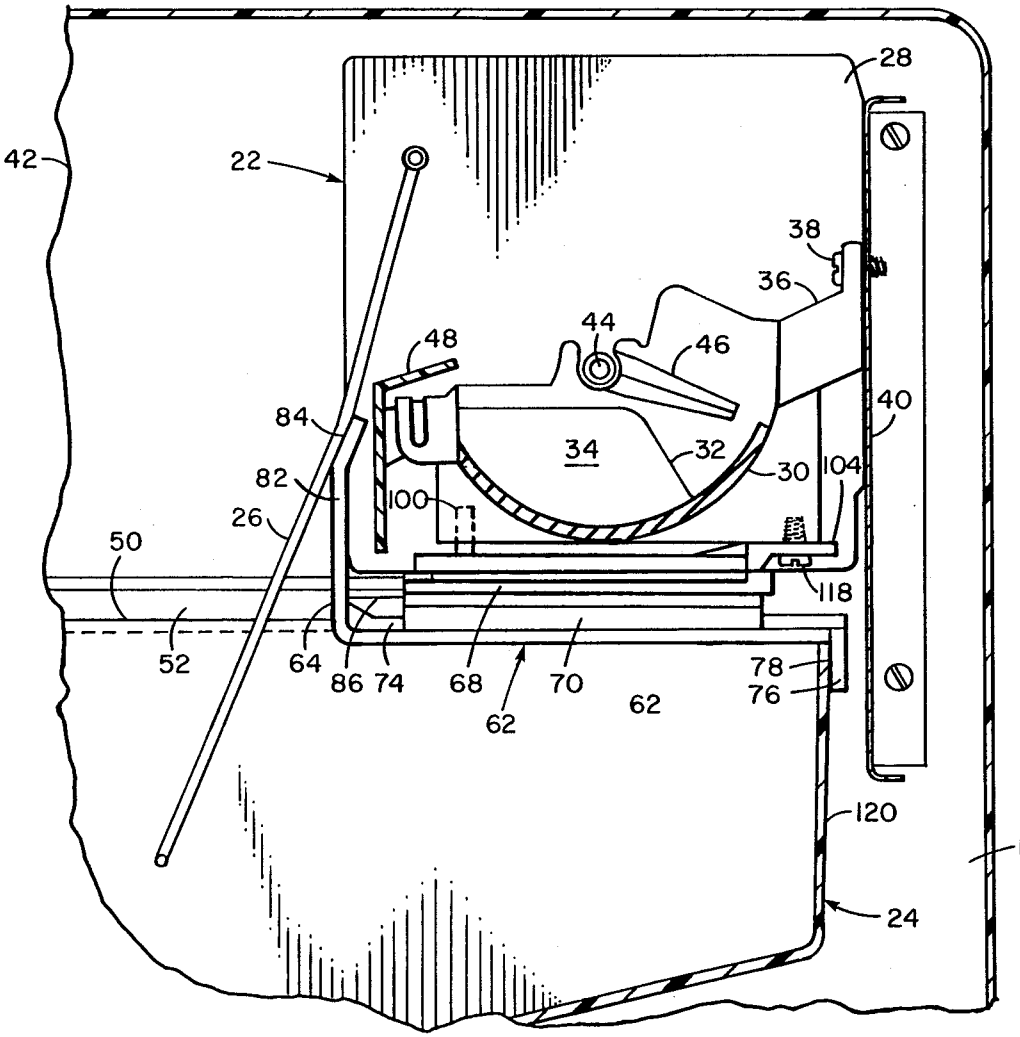
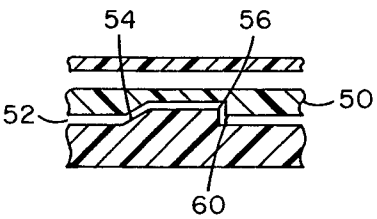
FIG. 4

SHUT-OFF MECHANISM FOR ICE MAKER

BACKGROUND OF THE INVENTION

The field of the invention generally relates to automatic ice makers for household refrigerators, and more particularly relates to apparatus for disabling such an ice maker when the ice storage bin is not properly positioned to receive ice.

Automatic ice makers have been commonly used in freezer compartments of household refrigerators for many years. Generally, ice makers include a mold or tray, and apparatus for automatically filling the mold cavities with a charge of water. After the water is frozen in the mold as determined by some suitable device such as, for example, a temperature sensor or timer, the ice cubes are harvested by an ejector mechanism that discharges the ice cubes into an ice storage bin or bucket. Then, starting with the step of refilling the mold with water, the cycle is automatically repeated over and over.

Automatic ice makers have used ice-level sensors that shut-off or deactivate the harvesting of ice when a predetermined level of ice has been reached in the storage bin. For example, it is desirable that the ice be made at a relatively fast rate so as to keep up with a heavy use period. However, during normal operation, significant periods of time pass when relatively little or no ice is removed from the storage bin. If an ice maker were permitted to continue to make and harvest ice at the relatively fast rate during an extended low use period, the ice would overflow the storage bin and fill the freezer compartment.

One common ice-level sensor includes a feeler arm that is pivotally positioned for moving down into the ice storage bin. Just prior to harvesting the ice, the feeler arm is automatically rotated up out of the way so that ice may be dumped into the ice storage bin. The feeler arm is then automatically lowered back into the storage bin until its downward motion is stopped by contact with the ice in the storage bin. If the ice in the bin is below a predetermined level, the feeler arm rotates to a relatively low position before it contacts the ice and, in response thereto, the automatic ice maker continues to cycle thereby continuing to fill the ice storage bin. If, however, the ice in the bin is above a predetermined level, the feeler arm contacts the ice and is stopped at a relatively high position and, in response thereto, the automatic ice maker is shut off or deactivated. As a result, no additional ice is harvested by the ice maker until sufficient ice has been removed from the storage bin so that the feeler arm pivots downwardly below the predetermined level.

Typically, the ice storage bin is removable from the freezer compartment so that the ice can be conveniently removed from it. One problem with such an automatic ice maker is that if the ice storage bin is intentionally or inadvertently not replaced back into the freezer compartment, the feeler arm stays in a relatively low sensing position such that ice continues to be made and harvested even though the ice storage bin is not there to collect the ice. It is noted that some ice makers have feeler arms that can be manually rotated to an out-of-service position that stops the production of ice. However, even with these units, if the operator forgets or doesn't know to disable the ice maker manually, ice will continue to be made after the storage bin is removed. Another problem is that a typical ice storage bin has a relatively deep lateral notch in one wall so that the storage bin can be inserted and removed from the freezer compartment without contacting and bending the feeler arm in the low position. When the storage bin is removed from the freezer compartment, ice may fall out of the notch.

SUMMARY OF THE INVENTION

It is an object of the invention to provide an ice maker that is automatically deactivated if the ice storage bin is not properly positioned to receive the ice.

It is also an object to provide apparatus that is responsive to the absence of the ice storage bin for deactivating or disabling the making and/or harvesting of ice.

It is a further object to provide an automatic ice maker that does not fill the freezer compartment with ice pieces when the ice storage bin is not present.

It is a further object to provide an automatic ice maker having a feeler arm for sensing the ice level within the storage bin wherein only a relatively shallow notch is required in the back wall of the storage bin for sliding the storage bin in and out of the freezer compartment underneath the feeler arm.

In accordance with the invention, these and other objects and advantages are provided by an ice maker shut-off mechanism adapted for cooperating with an ice level feeler arm to disable the harvesting of ice when the ice storage bin is absent, the mechanism comprising means biased in a first position for urging the feeler arm to disable the ice maker from harvesting ice, and means for securing the urging means in a second position wherein the feeler arm is free to sense the level of ice in a normal manner, the securing means comprising means for engaging the storage bin wherein insertion of the storage bin into position for receiving ice from the ice maker provides a force for overcoming the bias of the urging means. It may be preferable that the urging means comprise a plunger having a paddle for contacting the feeler arm, the plunger being biased by a spring which pushes it towards a first position. Also, it also may be preferable that the urging means further comprise a case having a bore and casing spring wherein the plunger is inserted in front of the spring so that the spring provides a forward force on the plunger. Further, it is preferable that the engaging means comprise a vertical blade extending downwardly from the plunger and being adapted for receiving an insertion force from the storage bin to move the plunger to the second position thereby compressing the spring. By disable the harvesting of ice it is generally meant that the automatic operation of the ice maker is interrupted. This can occur at any stage during an ice making cycle, but preferably occurs after the ice pieces are formed, but before they are ejected into the ice storage bin. The normal manner of feeler arm operation is that if ice is sensed above a predetermined level, harvesting is interrupted, but if it is below the predetermined level, the ice maker continues to cycle.

The invention can also be practiced by the method of disabling an automatic ice maker having an ice feeler arm from harvesting ice when the ice storage bin is not positioned to receive the ice, comprising the step of activating automatically in response to the removal of the storage bin a paddle to push the feeler arm to a position deactivating the harvesting of ice.

BRIEF DESCRIPTION OF THE DRAWINGS

The foregoing objects and advantages will be more fully understood by reading the Description of the Preferred Embodiment with reference to the drawings wherein:

FIG. 3 is a side sectioned view of the ice maker with the ice storage bin positioned below;

FIG. 4 is a side sectioned view showing the latching mechanism for securing the ice storage bin;

DESCRIPTION OF THE PREFERRED EMBODIMENT

Figure 1:
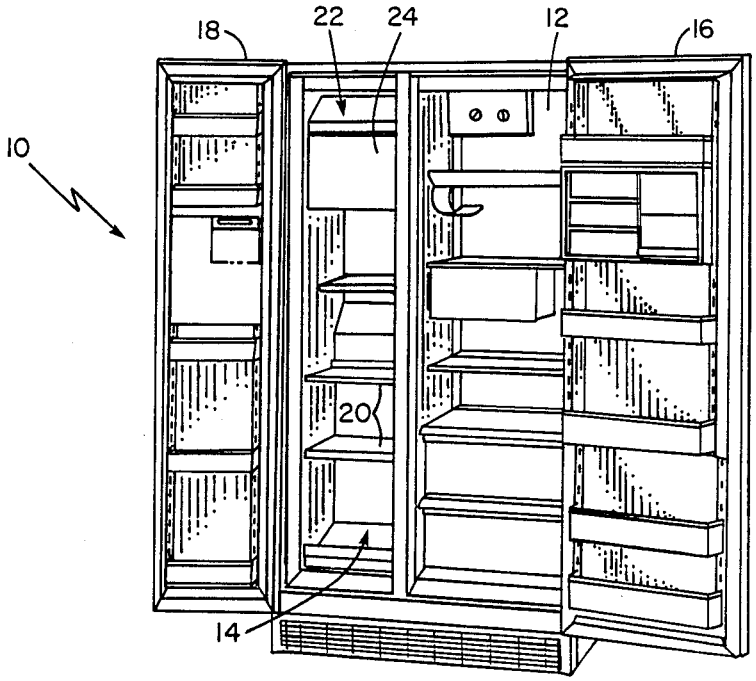
FIG. 1 is a front perspective view of a household refrigerator with the doors open.

Referring generally to the drawings wherein like reference numerals refer to like or similar parts throughout the several views, an ice maker shut-off mechanism 62 or assembly is adapted for cooperating with an ice level feeler arm 26 to disable or interrupt the harvesting of ice when the ice storage bin 24 is not properly positioned in the freezer compartment 14 for receiving ice. The mechanism 62 includes a plunger 64 which is biased by spring 66 inside case 112 to a forward position where paddle 82 urges feeler arm 26 to a raised position that deactivates ice maker 22 in the conventional way. When ice storage bin 24 is inserted into its proper operating position in freezer compartment 14, the back wall 120 or panel presses against blade 76 of plunger 64 forcing plunger 64 to a retracted position further inside case 112 overcoming a force exerted by spring 66. Accordingly, paddle 82 is removed from the region where it urges feeler arm 26 to disable ice maker 22, and therefore feeler arm 26 and ice maker 22 operate in the normal manner. As a result, ice is harvested by ice maker 22 only when the ice storage bin 24 is properly positioned, and then only when the ice level within the bin 24 is below a predetermined level.

Referring now specifically to FIG. 1, a household refrigerator 10 is illustrated. Although here shown is a so-called side-by-side refrigerator 10 having a refrigerated or fresh food compartment 12 on the right and a freezer compartment 14 on the left, it should be understood that the invention can be used to advantage with many other types of refrigerators such as, for example, top mount and bottom mount models. The fresh food compartment 12 is closed by door 16 and the freezer compartment is closed by door 18. Freezer compartment 14 has number of shelves 20 and an automatic ice maker 22 that includes an ice storage bin 24 or container.

Figure 2:
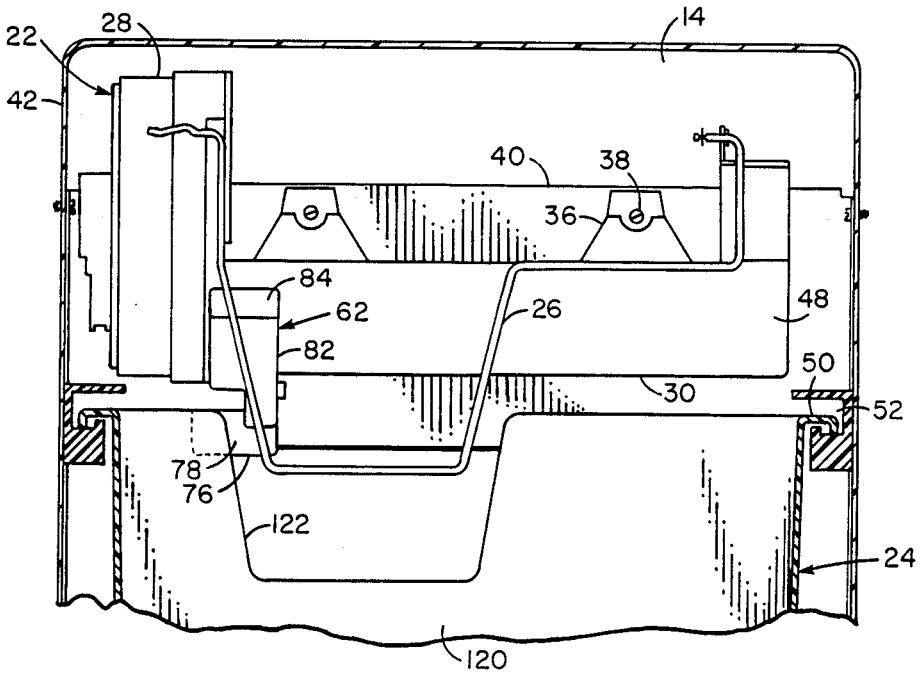
FIG. 2 is a front sectioned view of the ice storage bin of FIG. 1 showing the automatic ice maker.

Referring specifically to FIGS. 2 and 3, front and side sectioned views of automatic ice maker 22 are shown. Although only one embodiment of ice maker 22 is shown and described herein, those skilled in the art will understand that the invention described subsequently can be used to advantage with many other types of ice makers including a wide variety of ice making and harvesting mechanisms, so long as apparatus such as sensing or feeler arm 26 is provided for determining the level of ice pieces stored in ice storage bin 24.

Although the details of ice maker 22 are well known and unnecessary for an understanding of the present invention, ice maker 22 here includes a control housing 28 that encases various conventional controls (not shown) such as, for example, timers, temperature sensitive switches, and gear mechanisms that are used to cycle ice maker 22 through stages of making and harvesting ice. For example, the first step in making ice is to load a predetermined charge of water into ice mold 30 or ice forming tray that has a plurality of partitions 32 separating the mold into different cavities 34 for forming ice pieces or cubes. The ice mold 30 is affixed by brackets 36 and screws 38 to a back plate 40 that is mounted to the walls 42 of the freezer compartment 14. In one typical embodiment, the temperature within ice mold 30 is monitored and, when it drops to a predetermined temperature such as, for example, 17° F., the harvesting step is initiated. In the harvesting phase, it may first be desirable to activate heaters (not shown) within the mold so as to melt and thereby disengage the ice pieces from ice mold 30. Then, a shaft 44 is rotated counterclockwise as shown in FIG. 3 and the ejector arms 46 contact the individual ice pieces within the cavities 34 moving them initially rearwardly and upwardly, and then forwardly where they engage ice slide panel 48 from where they fall forwardly into ice storage bin 24. Next, another such cycle is automatically repeated thereby filling ice storage bin 24 with ice pieces.

Generally, ice pieces may be removed from ice storage bin 24 or receptacle by reaching in from the top as the bin 24 is shown in FIG. 1, or, in the alternative, ice storage bin 24 may be slid out of freezer compartment 14 so that a large quantity of ice can be conveniently removed. For sliding ice storage bin 24 out, it is provided with laterally projecting support flanges 50 that seat in guide slots 52 or rails at the sides 42 of the freezer compartment 14. In order to ensure that ice storage bin 24 is securely seated in its proper position during normal operation of automatic ice maker 22, guide slots 52 have small ramps 54 at the front which drop off forming rear steps 56 or stops as shown in FIG. 4. Also, the underside of flanges 50 have corresponding downwardly projecting bumps 60 that mate with steps 56 and prevent forward sliding. Accordingly, to remove ice storage bin 24, it is first lifted slightly so that downwardly projected bumps 60 rise above rear steps 56, and then ice storage bin 24 is free to be slid outwardly to the front on guide slots 52. When inserting ice storage bin 24, the flanges 50 glide upwardly on ramps 54.

Ice storage bin 24 is, of course, of limited storage capacity. Therefore, it is necessary to interrupt or disable operation of automatic ice maker 22 before the amount of ice discharged into storage bin 24 exceeds its storage capacity. For such purpose, automatic ice makers 22 have conventionally used a sensing or feeler arm 26 that is pivotally mounted for rotation down into the ice storage bin 24. Commonly, feeler arms 26 are manually rotatable to an upward position wherein ice maker 22 is in a vacation mode when no ice is made. When feeler arm 26 is in an operational position, it is normally raised by suitable gear mechanisms prior to a harvesting operation so it is out of the way when ice pieces are being dumped into ice storage bin 24. For example, if feeler arm 26 were in the position s shown in FIG. 3 while ice was being harvested, the ice could lodge and be trapped between feeler arm 26 and ice slide 48 there-after providing an inaccurate sensing of the ice level. After each harvesting operation, feeler arm 26 is then automatically lowered back down into ice storage bin 24. If the ice pieces in storage bin 24 are below a predetermined level, feeler arm 26 is free to pivotally rotate in a counterclockwise direction as shown in FIG. 3 to an angular orientation which is indicative that more ice can be added to storage bin 24. More specifically, the rotation of feeler arm 26 is sensed and if it is a low position as shown in FIG. 3, automatic ice maker 22 continues to make and harvest ice in a cyclical operation thereby continuing to fill ice storage bin 24. If, however, storage bin 24 is filled with ice pieces above a predetermined level, feeler arm 26 contacts the ice and further pivotal rotation in the downward direction is prevented. Such inability of feeler arm 26 to rotate further downwardly causes the controls of automatic ice maker 22 to discontinue or interrupt further harvesting of ice. More specifically, a new charge of water may be directed into mold 30, but a subsequent harvesting operation does not occur until ice is removed from storage bin 24 such that feeler arm 26 rotates below a predetermined position within storage bin 24. The operation of ice maker 22 and feeler arm 26 described heretofore with specific reference to FIGS. 1, 2 and 3 is conventional and well known in the art.

In accordance with the invention, shut-off assembly or mechanism 62 is provided to disable or deactivate the automatic making of ice if the ice storage bin 24 is not properly positioned in the freezer compartment 14 underneath the automatic ice maker 22. More specifically with reference to FIG. 5, an exploded view of the shut-off assembly 62 shows a plunger 64, a spring 66, a case top 68 and a case bottom 70. Preferably, plunger 64, case top 68 and case bottom 70 are all injected molded plastic parts. Plunger 64 has a base member 72 which includes a longitudinal runner 74 or track. At the rear of base member 72 is a downwardly extending blade 76 preferably having a flat front surface 78. Extending upwardly from the front of base member 72 is a paddle 82 or hand that preferably has an inclined front surface 84. Connected to the back of paddle 82 and extending rearwardly in spaced parallel alignment above base member 72 is a shaft 86 that has a tab 88 extending laterally from one side.

Figure 6:
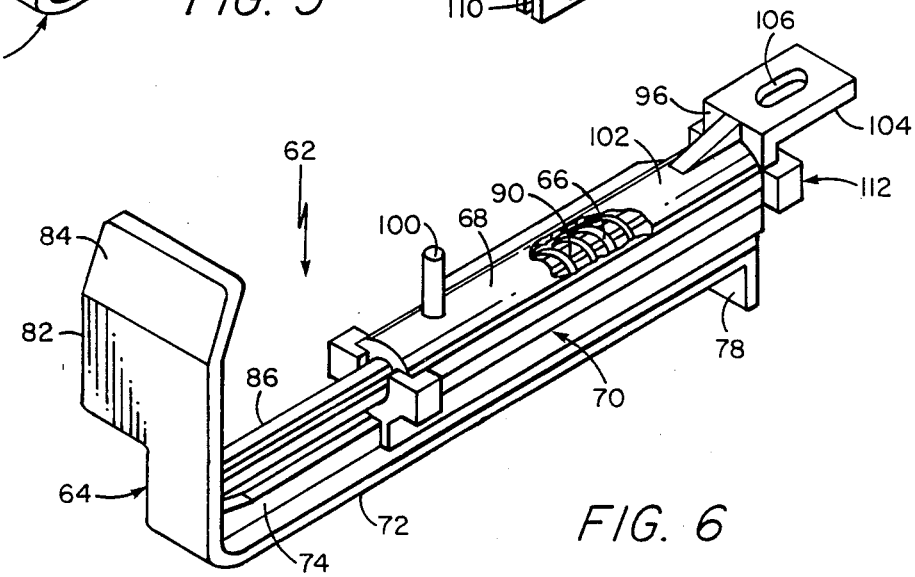
FIG. 6 is an assembled view of the storage bin sensor and ice maker shut-off mechanism.

Case top 68 and case bottom 70 are adapted for mating together in suitable manner as shown in FIG. 6 to form a longitudinal bore 90. Accordingly, both case top 68 and case bottom 70 have a longitudinal hollow 92 and 94, respectively, each of which is open at the front and terminated at the rear by an end portion 96 and 98, respectively. Case top 68 has a mounting pin 100 extending upwardly from the top surface 102, and a mounting bracket 104 with a screw hole 106 molded at the rear. Case bottom 70 has a longitudinal channel 108 communicating at the side of hollow 94. Further, case bottom 70 has a longitudinal groove 110 or slot running along the underside.

Figure 5:
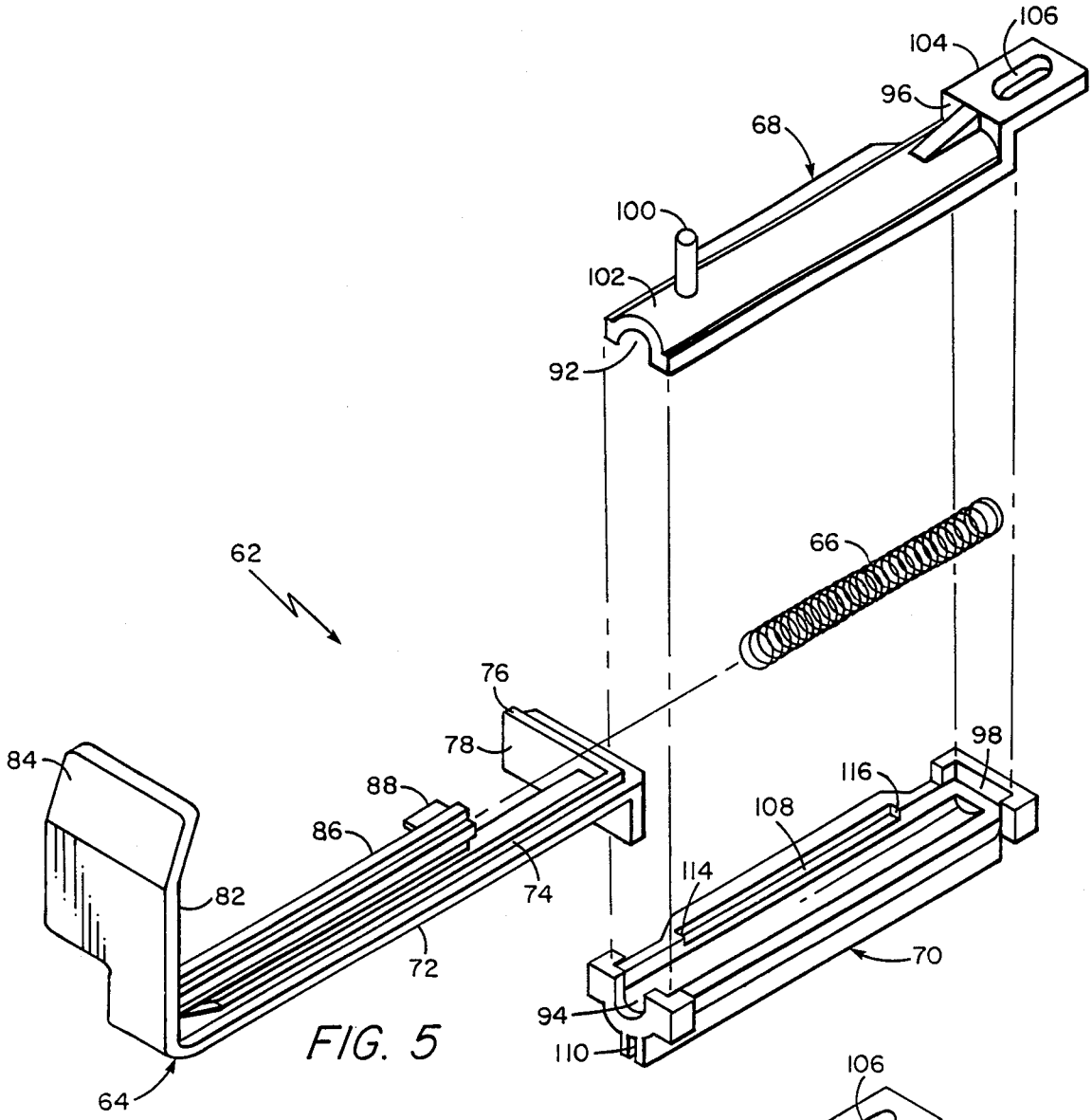
FIG. 5 is an exploded view of the storage bin sensor and ice maker shut-off mechanism.

In fabrication, and with further reference to FIGS. 5 and 6, the groove 110 of case bottom 70 is inserted onto runner 74 of plunger 64 such that shaft 86 extends into hollow 94 and tab 88 seats in channel 108. Then, spring 66 is positioned in hollow 94 of case bottom 70 at the rear of shaft 86, and case top 68 is lowered onto shaft 86 from the top such that it mates with case bottom 70. Case top 68 and case bottom 70 are then suitably affixed to each other forming case 112. Accordingly, shaft 86 extends into bore 90 formed by case top 68 and case bottom 70, and plunger 64 may be resiliently pushed into case 112 by applying a force sufficient to compress spring 66. The front-to-rear journey of shaft 86 in bore 90 is limited in both directions by tab 88 sliding in channel 108. More specifically, when no rear force is applied to plunger 64 such that spring 66 pushes plunger 64 forwardly, tab 88 contacts the front edge 114 of channel 108 thereby preventing further movement to the front which otherwise could lead to removal of plunger 64 from case 112. Also, when a force is applied to plunger 64 pushing it inwardly, the inward motion of plunger 64 is stopped when tab 88 contacts the rear edge 116 of channel 108. Accordingly, plunger 64 and case 112 are permanently connected to each other such that, under force, the plunger may be pushed into case 112 thereby compressing spring 66. However, if the force is not great enough to keep spring 66 compressed, spring 66 forces the plunger outwardly as runner 74 is guided along within groove 110 thereby maintaining axial alignment.

Figure 7:
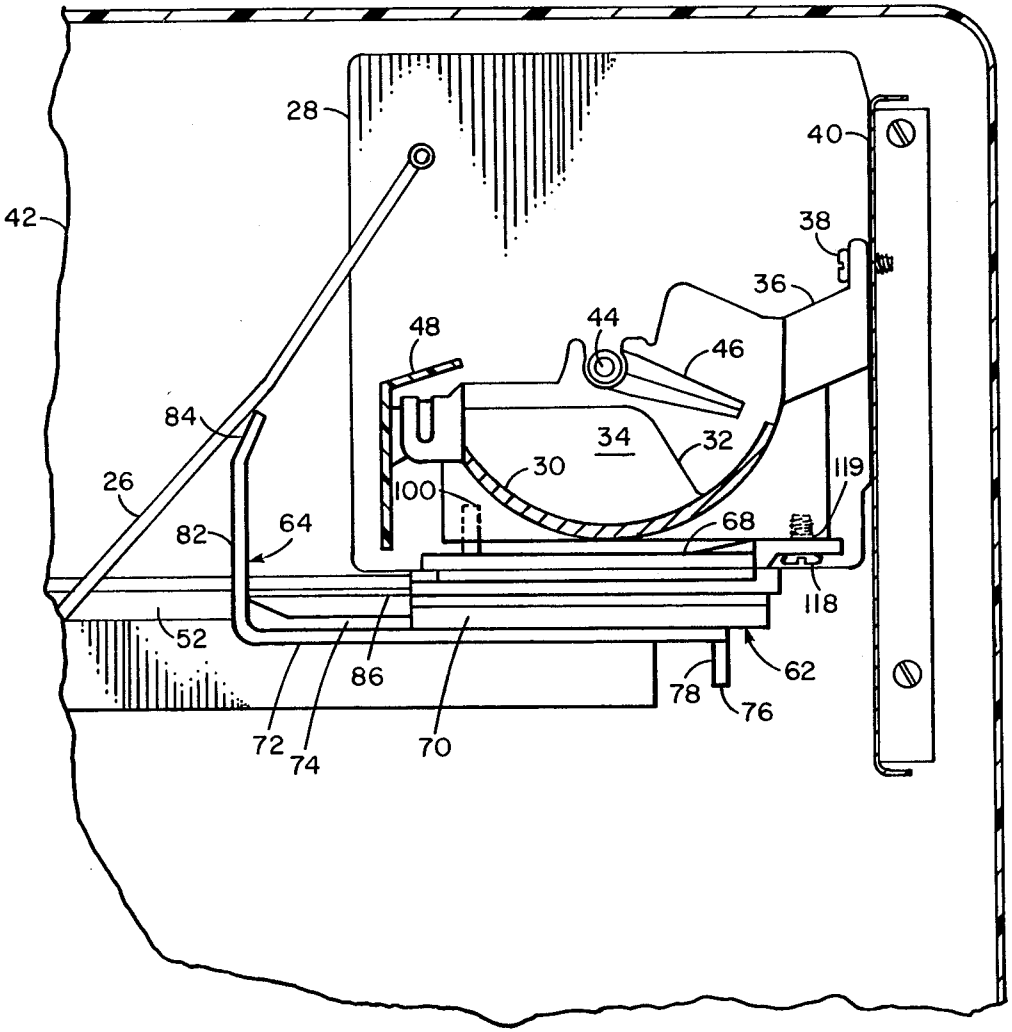
FIG. 7 is a side sectioned view of the automatic ice maker with the ice storage bin removed.

Referring again to FIGS. 2 and 3, and also to FIG. 7, shut-off assembly 62 is mounted on the underside of ice maker 22 as shown. More specifically, there is a hole for receiving mounting pin 100 and screw 118 is inserted through screw hole 119 and securely attached underneath ice mold 30. Accordingly, case 112 is rigidly affixed under ice mold 30, and plunger 64 may be pushed rearwardly by a sufficient force, but otherwise is pushed to the forward position as shown in FIGS. 6 and 7 by spring 66.

In operation, when ice storage bin 24 is inserted into freezer compartment 14 along guide slots 52, the back panel 120 engages blade 76 and plunger 64 is pushed rearwardly compressing spring 66. When bumps 60 engage steps 56, forward motion of ice storage bin 24 is prevented thereby latching ice storage bin 24 and plunger 64 in the position shown in FIG. 3. In such operating position, feeler arm 26 is free to move downwardly to the position shown, which position does not deactivate ice maker 22 but, rather, to the contrary, enables further making and harvesting of ice unless feeler arm 26 contacts the ice above the predetermined level.

Now, referring to FIG. 7, when ice storage bin 24 is removed from freezer compartment 14, plunger 64 is pushed to the forward position as shown by spring 66. Because feeler arm 26 aligns with the inclined surface 84 of paddle 82 as shown in FIG. 2, feeler arm 26 is rotated upwardly by plunger 64. In accordance with the invention, the angle to which plunger 64 pushes feeler arm 26 when the storage bin 24 is removed is above the predetermined ice level at which ice maker 22 is deactivated. Stated differently, removal of storage bin 24 from freezer compartment 14 causes shut-off assembly 62 to disable harvesting of ice, and, if the storage bin 24 is inadvertently left out, such disablement continues indefinitely. In short, shut-off assembly 62 provides an automatic way of disabling ice maker 22 when storage bin 24 is not present so that ice maker 22 does not continue to run thereby filling up freezer compartment 14 with ice.

Further, referring again to FIG. 2, a lateral notch 122 is shown in the back panel 120 of ice storage bin 24. The notch is provided so that if the operator attempts to push the ice storage bin 24 back into the operating position when the feeler arm 26 is not upwardly engaged, the back panel 120 will not push against the feeler arm 26 and cause damage. In other words, notch 122 is provided so that the back panel 120 can slide underneath feeler arm 26 when it is in the low position. In accordance with the invention, shut-off assembly 62 elevates feeler arm 26 to a higher position as shown in FIG. 7 than it otherwise would be as shown in FIG. 3. Accordingly, when ice storage bin 24 is removed, feeler arm 26 is held at a higher position such that notch 122 does not have to be so deep as it would otherwise have to be in order to ensure that back panel 120 can slip under feeler arm 26 during insertion. In other words, as ice storage bin 24 is removed from the position shown in FIG. 3, back panel 120 moves forward thereby releasing blade 76 to that spring 66 pushes plunger 64 forwardly thereby rotating feeler arm 26 to the raised position shown in FIG. 7. Accordingly, notch 122 does not have to be deep because any time ice storage bin 24 is slid under feeler arm 26 when either inserting or removing ice storage bin 24, feeler arm 26 is in the raised position shown in FIG. 7 rather than the low position shown in FIG. 3. It is advantageous to have a notch 122 that is as shallow as possible because it is therefore possible for storage bin 24 to hold more ice without some dropping out of notch 122.

This concludes the Description of the Preferred Embodiment. However, a reading of it by those skilled in the art will bring to mind many alterations and modifications without departing from the spirit and scope of the invention. Accordingly, it is intended that the scope of the invention be limited only by the appended claims.

What is claimed is:

1. An ice maker shut-off mechanism adapted for cooperating with an ice level feeler arm to disable harvesting of ice when the ice storage bin is absent, said mechanism comprising:

means biased in a first position for urging said feeler arm to disable said ice maker from harvesting ice; and means for securing said urging means in a second position wherein said feeler arm is free to sense to level of ice in a normal manner, said securing means comprising means for engaging said storage bin wherein insertion of said storage bin into position for receiving ice from said ice maker provides a force for overcoming the bias of said urging means, said urging means comprising a plunger having a paddle for contacting said feeler arm, said urging means further comprising a spring for biasing said plunger towards said first position wherein said urging means further comprises a case having a bore, said spring being positioned in said bore behind said plunger.

2. The mechanism recited in claim 1 wherein said engaging means comprises a vertical blade extending downwardly from said plunger and being adapted for receiving an exertion force from said storage bin to move said plunger to said second position while compressing said spring.

3. In a freezer compartment of a household refrigerator, the combination comprising:

a removable ice container;

an automatic ice maker positioned for periodically dumping a load of ice into said ice container, said ice maker having a feeler arm for sensing the level of ice in said container and shutting off said ice maker in response to ice being above a predetermined level; and means for urging said feeler arm to a position shutting off said automatic ice maker when said ice container is absent wherein said urging means comprises a case secured to said ice maker and a plunger member, said case having a longitudinal bore receiving said plunger member and a spring resiliently pushing said plunger member, said plunger member having a plate adapted for engaging said ice storage bin wherein, when said ice storage bin is present in said freezer compartment, said plunger member is held in a first position within said bore and, when said ice storage bin is absent from said freezer compartment, said spring pushes said plunger member outwardly against said feeler arm so that said feeler arm is urged to said position shutting off said ice maker.

4. The combination recited in claim 3 wherein said plunger member comprises a paddle for engaging said feeler arm.

5. The combination recited in claim 4 wherein said case comprises an upwardly extending mounting pin and a mounting bracket for affixing said urging means to said ice maker.

6. The combination recited in claim 5 wherein said ice storage bin has a back wall with a notch aligned with said feeler arm.

* * * * *